US010821042B1

(12) United States Patent
Williams

(10) Patent No.: US 10,821,042 B1
(45) Date of Patent: Nov. 3, 2020

(54) PATIENT BED WITH MATTRESS AND INTEGRATED BED PAN

(71) Applicant: Beatrice Williams, Indianapolis, IN (US)

(72) Inventor: Beatrice Williams, Indianapolis, IN (US)

( * ) Notice: Subject to any disclaimer, the term of this patent is extended or adjusted under 35 U.S.C. 154(b) by 268 days.

(21) Appl. No.: 15/936,745

(22) Filed: Mar. 27, 2018

(51) Int. Cl.

| | |
|---|---|
| ***A61G 7/02*** | (2006.01) |
| ***A61G 7/015*** | (2006.01) |
| ***A61G 7/05*** | (2006.01) |
| ***A61G 7/08*** | (2006.01) |
| ***A47C 27/08*** | (2006.01) |
| ***A47C 23/00*** | (2006.01) |
| ***A47C 27/00*** | (2006.01) |

(52) U.S. Cl.
CPC ..... *A61G 7/02* (2013.01); *A61G 7/015* (2013.01); *A47C 23/00* (2013.01); *A47C 27/00* (2013.01); *A47C 27/082* (2013.01); *A61G 7/0506* (2013.01); *A61G 7/0516* (2016.11); *A61G 7/08* (2013.01)

(58) Field of Classification Search
CPC . A61G 7/02; A61G 7/015; A61G 7/08; A61G 7/0516; A61G 7/0506; A61G 7/047; A61G 9/003; A61G 9/02; A47C 27/082; A47C 23/00; A47C 27/00; A47C 17/86
USPC ..... 5/604; 4/450, 461, 485, 479, 474, 465, 4/464, 458, 451, 478, 483
See application file for complete search history.

(56) References Cited

U.S. PATENT DOCUMENTS

| | | | | | |
|---|---|---|---|---|---|
| 10,840 | A * | 4/1854 | Van Allen | A61G 7/05 | 5/600 |
| 26,534 | A * | 12/1859 | Taillant | A61G 7/02 | 5/604 |
| 26,866 | A * | 1/1860 | Spencer | A47K 13/24 | 4/485 |
| 77,193 | A * | 4/1868 | Iske | A61G 7/02 | 5/604 |
| 103,029 | A * | 5/1870 | Drake | A01N 47/22 | 4/464 |
| 109,276 | A * | 11/1870 | Vanderveer | A01N 47/22 | 4/464 |
| 118,681 | A * | 9/1871 | Bliss | A01N 47/22 | 4/464 |
| 122,784 | A * | 1/1872 | Sherman | A01N 47/22 | 4/464 |
| 188,699 | A * | 3/1877 | Van Court | A47K 13/24 | 4/485 |
| 192,096 | A * | 6/1877 | Thompson | A01N 47/22 | 4/464 |

(Continued)

FOREIGN PATENT DOCUMENTS

WO 2000048545 8/2000

*Primary Examiner* — Eric J Kurilla
*Assistant Examiner* — Luke Hall

(57) ABSTRACT

The patient bed with mattress and integrated bed pan includes a bed frame, mattress sections, and an integral bed pan. A midframe and mid mattress are removable to access to the bed pan. The frame and mattress sections may be pivoted to place the patient in a seated position. The bed pan may be located in a drawer under the midsection of the patient and may be retrieved after use by opening the drawer. A clean bed pan may be placed into an inclined bed by releasing it into a bed pan aperture and allowing it to slide through a guide track to the receiving compartment.

18 Claims, 4 Drawing Sheets

(56) References Cited

U.S. PATENT DOCUMENTS 211,114 A * 1/1879 Sinclair ..... A61G 7/02 5/604
218,589 A * 8/1879 Sprint ..... A47K 13/24 4/485
222,581 A * 12/1879 Fowler ..... A47K 11/04 4/478
268,238 A * 11/1882 Johnson ..... A61G 7/015 5/617
283,515 A * 8/1883 Rodgers ..... A61G 7/02 5/604
288,824 A * 11/1883 Loth ..... A47K 11/04 4/478
334,151 A * 1/1886 Anthony ..... A47K 11/02 4/474
341,135 A * 5/1886 Ellison ..... A47K 11/04 4/478
RE10,773 E * 10/1886 Johnson ..... 5/604
366,982 A * 7/1887 Smith ..... A61G 7/02 5/604
434,244 A * 8/1890 Carrico ..... A47K 11/02 4/474
473,360 A * 4/1892 Shaw ..... A47K 11/04 4/478
494,079 A * 3/1893 Phillips ..... A47K 11/06 4/479
548,543 A * 10/1895 Hecox ..... A01N 47/22 4/464
550,613 A * 12/1895 Harvey ..... A47K 11/04 4/478
554,580 A * 2/1896 Conkwright ..... A61G 7/001 5/618
585,646 A * 7/1897 Ames ..... A61G 7/02 5/604
608,619 A * 8/1898 McKnight ..... A61G 7/02 5/604
622,317 A * 4/1899 Zucker ..... A61G 7/02 5/604
659,308 A * 10/1900 Lemmons et al. ..... A61G 7/02 5/604
663,427 A * 12/1900 Eddy ..... A61G 7/015 5/618
713,416 A * 11/1902 Feely ..... A61G 7/02 5/604
718,746 A * 1/1903 Bennett ..... A61G 7/02 5/604
722,705 A * 3/1903 Heatley ..... A61G 7/02 5/604
730,010 A * 6/1903 Feely ..... A61G 7/02 5/604
787,162 A * 4/1905 Feely ..... A61G 7/02 5/604
801,667 A * 10/1905 Kintz ..... A61G 7/015 5/618
815,969 A * 3/1906 MacFarlane ..... A01N 47/22 4/464
828,754 A * 8/1906 Lopitsch et al. ..... A61G 7/02 5/604
829,481 A * 8/1906 Mitchell ..... A61G 7/02 5/604
836,334 A * 11/1906 Newman ..... A61G 9/003 4/450
847,619 A * 3/1907 Taylor ..... A61G 7/015 5/618
861,092 A * 7/1907 Oling ..... A61G 7/015 5/618
867,712 A * 10/1907 Elo ..... A61G 7/02 5/604
878,045 A * 2/1908 Collins ..... A61G 7/02 5/604
890,832 A * 6/1908 Albright ..... A01N 47/22 4/464
912,856 A * 2/1909 Koons ..... A01N 47/22 4/464
963,538 A * 7/1910 Ford ..... A61G 7/015 5/618
1,046,830 A * 12/1912 McDonald et al. ..... A61G 7/02 5/604
1,086,584 A * 2/1914 Brown ..... A61G 9/003 4/450
1,096,843 A * 5/1914 Klein ..... A01N 47/22 4/464
1,100,303 A * 6/1914 Hooper ..... A61G 7/02 5/604
1,151,014 A * 8/1915 Hipkoe ..... A61G 7/015 5/618
1,177,390 A * 3/1916 Daniel ..... A47C 17/86 5/308
1,179,907 A * 4/1916 Fletcher et al. ..... A61G 7/015 5/618
1,181,001 A * 4/1916 Griesel ..... A61G 9/003 4/450
1,186,059 A * 6/1916 Yarrington ..... A47C 1/0355 297/68
1,222,157 A * 4/1917 Stephenson ..... A47K 11/02 4/474
1,224,478 A * 5/1917 McNeil ..... A61G 7/02 5/604
1,227,022 A * 5/1917 Thompson ..... A61G 7/02 5/695
1,250,946 A * 12/1917 Belden ..... A47C 17/86 5/308
1,300,364 A * 4/1919 FitzGerald ..... A61G 7/02 5/604
1,307,668 A * 6/1919 Henderson ..... A61G 7/02 5/604
1,350,333 A * 8/1920 Emilie ..... A61G 7/02 5/695
1,368,211 A * 2/1921 Kellum ..... A61G 7/02 5/695
1,407,631 A * 2/1922 Brown ..... A61G 7/02 5/604
1,445,836 A * 2/1923 Kowalsky ..... A61G 9/003 4/450
1,490,029 A * 4/1924 Scheliga ..... A61G 7/02 5/604
1,528,835 A * 3/1925 McCollough ..... A61G 7/02 5/84.1
1,608,038 A * 11/1926 Rogers ..... A47K 13/24 4/485
1,636,705 A * 7/1927 Prettenthaler ..... A61G 7/02 5/604
1,691,620 A * 11/1928 Wilson ..... A61G 5/1002 4/480
1,844,864 A * 2/1932 Saunders ..... A61G 7/02 5/604
1,884,577 A * 10/1932 Comper ..... A61G 7/02 5/604
1,899,263 A * 2/1933 Elliott ..... A61G 7/02 5/604
1,903,901 A * 4/1933 Masslow ..... A61G 7/02 5/604
1,949,035 A * 2/1934 Beurschgens ..... A61G 7/02 5/695
1,949,315 A * 2/1934 Levernier ..... A47K 5/1205 222/179
1,974,101 A * 9/1934 Comper ..... A61G 7/015 5/604
1,998,061 A * 4/1935 Wachs ..... A61G 9/003 4/450
2,058,428 A * 10/1936 Dry ..... A61G 7/02 5/604
2,115,111 A * 4/1938 Lobb ..... A61G 7/02 5/604
2,118,261 A * 5/1938 Marzano ..... A61G 7/02 5/604
2,165,385 A * 7/1939 Kane ..... A61G 7/02 5/604

(56) References Cited

U.S. PATENT DOCUMENTS 2,174,582 A * 10/1939 Hudon ..... A47C 17/86 5/308
2,186,009 A * 1/1940 Clark ..... A01K 31/17 119/458
2,215,636 A * 9/1940 Comper ..... A61G 7/015 5/618
2,267,973 A * 12/1941 Demcak ..... A61G 7/0502 5/617
2,294,236 A * 8/1942 Levernier ..... A47K 5/1205 222/179
2,307,897 A * 1/1943 Overholser ..... A47D 1/002 4/478
2,318,240 A * 5/1943 Mas ..... A61G 7/02 5/604
2,390,854 A * 12/1945 Thompson ..... A01K 1/011 119/161
2,492,589 A * 12/1949 Nemmer ..... A47C 7/002 248/346.5
2,500,361 A * 3/1950 Jordan ..... A21B 3/18 193/47
2,526,879 A * 10/1950 Kizaur ..... A61B 6/04 378/179
2,537,906 A * 1/1951 Over ..... A61G 7/02 5/695
2,573,104 A * 10/1951 La Baw ..... A47K 11/06 297/378.1
2,592,025 A * 4/1952 Gray ..... A61G 5/006 297/344.15
2,605,151 A * 7/1952 Shampaine ..... A61G 13/0009 5/602
2,618,787 A * 11/1952 Dickson ..... A61G 7/02 5/604
2,632,185 A * 3/1953 De Eckart ..... A61G 7/02 5/604
2,635,899 A * 4/1953 Osbon, Jr. ..... A61G 7/02 280/211
2,644,957 A * 7/1953 Shudde ..... A61G 7/02 5/695
2,654,899 A * 10/1953 Yaczola ..... A61G 7/02 5/695
2,832,655 A * 4/1958 Adolphson ..... A61G 13/0009 5/602
2,869,614 A * 1/1959 Wamsley ..... A61G 5/006 280/230
2,872,689 A * 2/1959 Fournet ..... A61G 7/02 5/604
2,904,798 A * 9/1959 Heflin ..... A47B 23/025 5/621
2,923,950 A * 2/1960 Carter ..... A47K 11/04 4/478
2,924,832 A * 2/1960 Knowles ..... A47D 7/00 5/606
2,932,831 A * 4/1960 Keathley, Sr. ..... A61G 7/02 5/695
3,014,224 A * 12/1961 Hall ..... A61G 7/02 5/604
3,095,235 A * 6/1963 Babcock ..... A61G 5/006 297/68
3,175,227 A * 3/1965 Lowthers ..... A61G 7/02 4/450
3,245,090 A * 4/1966 Slimmer ..... A61G 5/1002 4/478
3,271,785 A * 9/1966 Du Bose ..... A61G 5/1002 4/480
3,319,263 A * 5/1967 Udden ..... A61G 9/003 4/452
3,323,146 A * 6/1967 Kappel ..... A61G 7/02 5/604
3,345,652 A * 10/1967 Hiraga ..... A61G 7/02 5/604
3,348,893 A * 10/1967 Katzfey ..... A61G 13/0018 312/209
3,364,478 A * 1/1968 Dee Waard ..... G08B 1/08 4/483
3,381,973 A * 5/1968 Carr ..... A61G 5/023 280/30
3,453,664 A * 7/1969 Gilbert ..... A61G 9/003 4/455
3,457,567 A * 7/1969 Criss ..... E03D 5/012 4/472
3,493,974 A * 2/1970 Smith ..... A47K 11/02 4/477
3,503,080 A * 3/1970 Laufer ..... A61G 9/003 4/451
3,568,219 A * 3/1971 Roberts ..... A47K 11/04 4/483
3,629,872 A * 12/1971 Parkison ..... E03D 11/025 4/300.2
3,654,643 A * 4/1972 Clanan ..... A61G 5/1002 5/83.1
3,655,179 A * 4/1972 Lelugas ..... A61G 13/0018 5/618
3,716,872 A * 2/1973 Zieman ..... A47K 13/00 297/188.1
3,769,638 A * 11/1973 Clanan ..... A47K 11/04 4/237
3,810,263 A * 5/1974 Taylor ..... A61G 7/1032 5/81.1 C
3,814,414 A * 6/1974 Chapa ..... A61B 6/04 5/601
3,818,516 A * 6/1974 Hopper ..... A61B 6/04 5/611
3,868,898 A * 3/1975 Sanford ..... B27F 7/155 100/35
3,887,951 A * 6/1975 Yates ..... A61G 7/015 5/618
3,922,735 A * 12/1975 Kato ..... A61G 7/02 5/605
4,003,704 A * 1/1977 Zurolo ..... A61G 13/0018 250/455.11
4,007,959 A * 2/1977 Juergens ..... A61G 5/08 297/42
4,030,149 A * 6/1977 Kato ..... A61G 7/02 5/604
4,067,409 A * 1/1978 DiMatteo ..... A61G 5/045 180/6.5
4,199,826 A * 4/1980 Devereux ..... A47K 11/02 4/479
4,244,066 A * 1/1981 Rukawina ..... A61G 7/02 5/691
4,291,929 A * 9/1981 Faust ..... A47B 88/43 312/334.4
4,296,506 A * 10/1981 Stoute, Sr. ..... A61G 5/1002 4/452
4,368,548 A * 1/1983 Glass ..... A61G 9/003 4/450
4,428,615 A * 1/1984 Hynson ..... A61G 5/1002 297/118
4,490,865 A * 1/1985 Hamaguchi ..... A61G 7/02 4/450
4,527,843 A * 7/1985 Murdoch ..... A61G 9/02 312/31.2
4,550,455 A * 11/1985 Carson ..... A41D 13/1254 297/352
4,571,759 A * 2/1986 Sasaki ..... A61G 7/02 4/478
4,685,159 A * 8/1987 Oetiker ..... A61G 7/002 5/608
4,713,848 A * 12/1987 Domovs ..... A61G 5/1002 280/304.1
4,718,133 A * 1/1988 DiMatteo ..... A61G 5/006 5/81.1 C
4,754,508 A * 7/1988 Nishiguchi ..... A61G 7/02 5/604
4,800,599 A * 1/1989 Korchinski ..... A61G 7/002 5/507.1
4,837,868 A * 6/1989 Allen ..... A47K 11/04 4/449

(56) References Cited

U.S. PATENT DOCUMENTS 4,847,929 A * 7/1989 Pupovic ..... A61G 7/008 5/608
4,920,587 A * 5/1990 Kerr ..... A47K 11/02 4/480
4,926,513 A * 5/1990 Oats ..... A47C 21/028 5/488
4,949,408 A * 8/1990 Trkla ..... A61G 5/006 297/DIG. 4
4,949,409 A * 8/1990 Stefano ..... A61G 7/02 5/604
4,968,013 A * 11/1990 Kuck ..... A61G 13/10 5/600
4,974,270 A * 12/1990 Kuhn ..... A61G 7/02 4/451
4,989,280 A * 2/1991 Bair ..... A61G 7/02 4/450
5,054,136 A * 10/1991 Inagaki ..... A61G 7/0005 4/546
5,077,845 A * 1/1992 Tokunaga ..... A61G 7/02 4/237
5,224,754 A * 7/1993 Jeanes, III ..... A47C 3/029 297/188.09
5,255,934 A * 10/1993 Wilson ..... A61G 5/045 180/907
5,285,535 A * 2/1994 Stewart ..... A47K 11/04 297/DIG. 4
5,327,599 A * 7/1994 Bradley, Jr. ..... A61G 7/02 5/604
5,351,349 A * 10/1994 Tsai ..... A61G 7/02 5/604
5,355,540 A * 10/1994 Allen ..... A61G 7/0005 4/547
5,359,737 A * 11/1994 Hodge ..... A47K 11/04 4/476
5,363,514 A * 11/1994 Lee ..... A61G 9/00 4/455
5,381,573 A * 1/1995 MacSanz ..... A61G 5/1002 4/465
5,535,464 A * 7/1996 Salonica ..... A61G 7/015 5/604
5,568,817 A * 10/1996 Harty ..... A61G 1/04 128/849
5,577,753 A * 11/1996 Pociask ..... A61G 5/08 280/250.1
5,608,925 A * 3/1997 Porter ..... A61G 5/1002 4/480
5,628,078 A * 5/1997 Pennington ..... A61B 6/04 5/613
5,715,548 A * 2/1998 Weismiller ..... A61G 7/00 5/611
5,725,275 A * 3/1998 Wigfall ..... A61G 5/1002 297/284.1
5,729,849 A * 3/1998 Garakani ..... A61G 7/015 5/618
5,806,114 A * 9/1998 Morgan ..... A61G 13/0009 5/602
5,848,443 A * 12/1998 Waugh ..... B60R 15/04 4/458
5,860,664 A * 1/1999 Smith ..... A61G 5/006 108/44
5,901,390 A * 5/1999 Williams ..... A61G 7/02 4/476
5,943,715 A * 8/1999 Matsuura ..... A61G 7/00 4/547
5,970,529 A * 10/1999 Veal ..... A61G 9/003 4/450
6,086,176 A * 7/2000 Aoyama ..... A47B 67/04 312/286
6,240,576 B1 * 6/2001 Cosby ..... A47K 11/02 4/483
6,243,898 B1 * 6/2001 Ruff ..... A61G 7/02 5/609
6,499,156 B1 * 12/2002 Dirst ..... A61G 7/1019 5/600
6,513,177 B1 * 2/2003 Beveridge ..... E03C 1/00 4/624
6,523,198 B1 * 2/2003 Temple ..... A61G 7/02 5/421
6,539,558 B2 * 4/2003 Shero ..... A47K 11/04 297/DIG. 4
6,623,022 B2 * 9/2003 Malassigne ..... A61G 5/08 280/250.1
6,647,571 B2 * 11/2003 Hynansky ..... A61G 7/02 5/604
6,681,413 B2 * 1/2004 Weiss ..... A47K 11/02 4/476
6,733,024 B1 * 5/2004 Savegnago ..... A61G 5/1002 280/250.1
6,795,988 B2 * 9/2004 Hueppe ..... A61G 7/05 5/424
6,802,093 B1 * 10/2004 Pope-Brown ..... A61G 7/02 5/604
6,877,572 B2 * 4/2005 Vogel ..... A61G 7/00 180/15
6,880,470 B2 * 4/2005 Sidor ..... A47B 77/18 108/25
6,954,951 B2 * 10/2005 Lieboff ..... A61G 5/00 5/603
6,976,278 B2 * 12/2005 Oetting ..... A61G 5/1002 297/188.09
7,363,663 B2 * 4/2008 Chambers ..... A61G 7/0507 5/185
7,386,899 B2 * 6/2008 Smith ..... A61G 13/0018 5/507.1
7,406,729 B2 * 8/2008 Hornbach ..... A47C 19/045 5/185
7,669,260 B2 * 3/2010 Smith ..... A61G 13/0018 5/604
7,686,319 B1 * 3/2010 Fink ..... A61G 5/107 280/304.1
7,836,525 B2 * 11/2010 Castillo ..... A61G 5/1002 4/476
7,992,240 B2 * 8/2011 Gladney ..... A47C 20/04 5/618
8,117,695 B2 * 2/2012 Paz ..... A61G 7/015 5/600
8,171,583 B1 * 5/2012 Hooker ..... A61G 7/02 5/604
8,407,838 B2 * 4/2013 Nakamura ..... A61G 7/02 5/604
8,510,881 B1 * 8/2013 Lee ..... A61G 7/02 5/308
8,578,530 B2 * 11/2013 Patwardhan ..... A61G 7/015 5/604
8,661,585 B1 * 3/2014 Alasfour ..... A61G 7/015 5/604
8,894,148 B2 * 11/2014 Bailey ..... B60N 2/32 297/118
8,898,838 B1 * 12/2014 Tu ..... A61G 7/015 5/604
9,155,429 B2 * 10/2015 Colombot ..... A47K 11/02
9,365,167 B1 * 6/2016 Lampkin ..... B60R 15/04
D783,332 S * 4/2017 Kim ..... D24/123
9,956,128 B1 * 5/2018 Phillips ..... A61G 7/015
10,238,559 B1 * 3/2019 Khaligh ..... A61G 7/02
10,363,187 B2 * 7/2019 Sineath, Jr. ..... A61G 7/1088
10,426,680 B2 * 10/2019 Williams ..... A61G 7/018
10,517,447 B2 * 12/2019 Nye ..... A47K 13/02
2002/0059679 A1 * 5/2002 Weismiller ..... A61G 7/0528 5/610
2002/0088056 A1 * 7/2002 Krempel ..... A61G 7/0005 5/604
2002/0144339 A1 * 10/2002 Colombot ..... A47K 11/02 4/449
2002/0162187 A1 * 11/2002 Keller ..... A47L 9/02 15/345
2002/0174483 A1 * 11/2002 Gallant ..... A61G 7/00 4/664

(56) References Cited

U.S. PATENT DOCUMENTS

2003/0213065 A1* 11/2003 Bristotti ..... A61G 7/015 5/604
2004/0034912 A1* 2/2004 Dippel ..... A47K 11/04 4/483
2005/0015877 A1* 1/2005 Qi ..... A61G 7/001 5/604
2005/0060797 A1* 3/2005 Gilmore ..... A47K 11/06 4/450
2005/0060798 A1* 3/2005 Diaz ..... A61G 9/003 4/453
2005/0132494 A1* 6/2005 Koga ..... A61G 7/0005 5/605
2005/0246829 A1* 11/2005 La Trobe ..... A47K 11/02 4/449
2006/0070181 A1* 4/2006 Stewart ..... A61G 13/0018 5/613
2007/0017015 A1* 1/2007 Finell ..... A47K 11/06 4/483
2007/0074338 A1* 4/2007 List ..... A47K 3/074 4/483
2008/0000028 A1* 1/2008 Lemire ..... A61G 7/001 5/618
2008/0229502 A1* 9/2008 Johnson ..... A61G 7/02 5/604
2008/0256708 A1* 10/2008 Park ..... A61G 7/02 5/605
2008/0290711 A1* 11/2008 Fernie ..... A61G 5/1002 297/338
2009/0293197 A1* 12/2009 Larson ..... A47C 19/04 5/618
2010/0017964 A1* 1/2010 Kruse ..... A61G 7/015 5/604
2010/0083441 A1* 4/2010 Ishida ..... A61G 7/002 5/604
2010/0088821 A1* 4/2010 Wang ..... A47C 21/04 5/604
2010/0125951 A1* 5/2010 Stefano ..... A61G 7/02 5/604
2010/0199429 A1* 8/2010 Patwardhan ..... A61G 7/015 5/604
2010/0301639 A1* 12/2010 McPheeters ..... A61G 9/003 297/118
2010/0306913 A1* 12/2010 Zazzara ..... A61G 9/003 4/451
2011/0145993 A1* 6/2011 Rader ..... A61G 7/02 5/604
2011/0162143 A1* 7/2011 Byun ..... A61G 7/0005 5/604
2011/0179571 A1* 7/2011 Clayton ..... A61G 7/02 5/605
2011/0277230 A1* 11/2011 Williams ..... A61G 5/1002 4/480
2012/0150081 A1* 6/2012 Pirli ..... A61F 5/451 601/49
2012/0233761 A1* 9/2012 Huang ..... A61F 5/442 4/458
2013/0185870 A1* 7/2013 Ishida ..... A61G 7/02 5/604
2014/0075664 A1* 3/2014 Colombot ..... A47K 11/02 4/483
2014/0137332 A1* 5/2014 McGuire ..... A47C 27/10 5/713
2014/0310875 A1* 10/2014 Iida ..... A61G 1/01 5/606
2014/0327232 A1* 11/2014 He ..... A61G 7/047 280/648
2015/0021963 A1* 1/2015 Reed ..... A47K 11/04 297/217.1
2015/0040325 A1* 2/2015 Bennett ..... A61G 7/02 5/691
2015/0067956 A1* 3/2015 Morin ..... A47K 11/02 4/479
2016/0022099 A1* 1/2016 Davis ..... A47K 11/04 4/483
2016/0029858 A1* 2/2016 Taylor ..... B60N 2/24 4/458
2016/0038356 A1* 2/2016 Yao ..... A61G 5/1002 280/304.1
2017/0027788 A1* 2/2017 Henderson ..... A61G 7/02
2018/0055705 A1* 3/2018 Sineath, Jr. ..... A61G 7/1007
2018/0353363 A1* 12/2018 Moneke ..... A61G 9/003
2019/0091083 A1* 3/2019 Carruthers ..... A61G 7/02
2019/0254897 A1* 8/2019 Tewes ..... A61G 7/02
2020/0030168 A1* 1/2020 Park ..... A61G 7/05

* cited by examiner

PATIENT BED WITH MATTRESS AND INTEGRATED BED PAN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of patient care, more specifically, a patient bed with mattress and integrated bed pan.

SUMMARY OF INVENTION

The patient bed with mattress and integrated bed pan comprises a bed frame, mattress sections, and an integral bed pan. A midframe and mid mattress are removable to access to the bed pan. In some embodiments, the frame and mattress sections may be pivoted to place the patient in a seated position. The bed pan may be located in a drawer under the midsection of the patient and may be retrieved after use by opening the drawer. In some embodiments a clean bed pan may be placed into an inclined bed by releasing it into a bed pan aperture and allowing it to slide through a guide track to the receiving compartment. The invention may comprise an air bladder for adjusting firmness and a pump to release sanitizing fluid into the bed pan. The invention may comprise a headrest, footrest, and side-rails for patient safety.

An object of the invention is to provide a patient bed with an integral bed pan.

Another object of the invention is to provide access to the bed pan by moving a mid frame and mid mattress from under the patient.

A further object of the invention is to provide access for retrieving the bed pan by sliding a side drawer open.

Yet another object of the invention is to allow the frame to be pivoted into a patient seated position.

These together with additional objects, features and advantages of the patient bed with mattress and integrated bed pan will be readily apparent to those of ordinary skill in the art upon reading the following detailed description of the presently preferred, but nonetheless illustrative, embodiments when taken in conjunction with the accompanying drawings.

In this respect, before explaining the current embodiments of the patient bed with mattress and integrated bed pan in detail, it is to be understood that the patient bed with mattress and integrated bed pan is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the patient bed with mattress and integrated bed pan.

It is therefore important that the claims be regarded as including such equivalent construction insofar as they do not depart from the spirit and scope of the patient bed with mattress and integrated bed pan. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
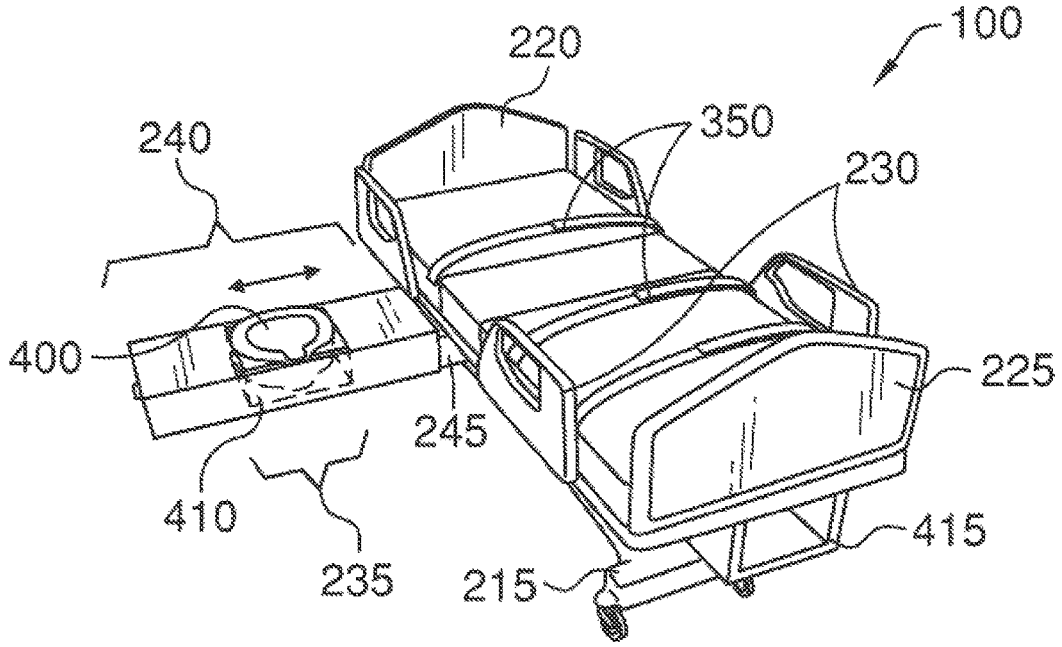
FIG. 1 is a perspective view of an embodiment of the disclosure.
Figure 2:
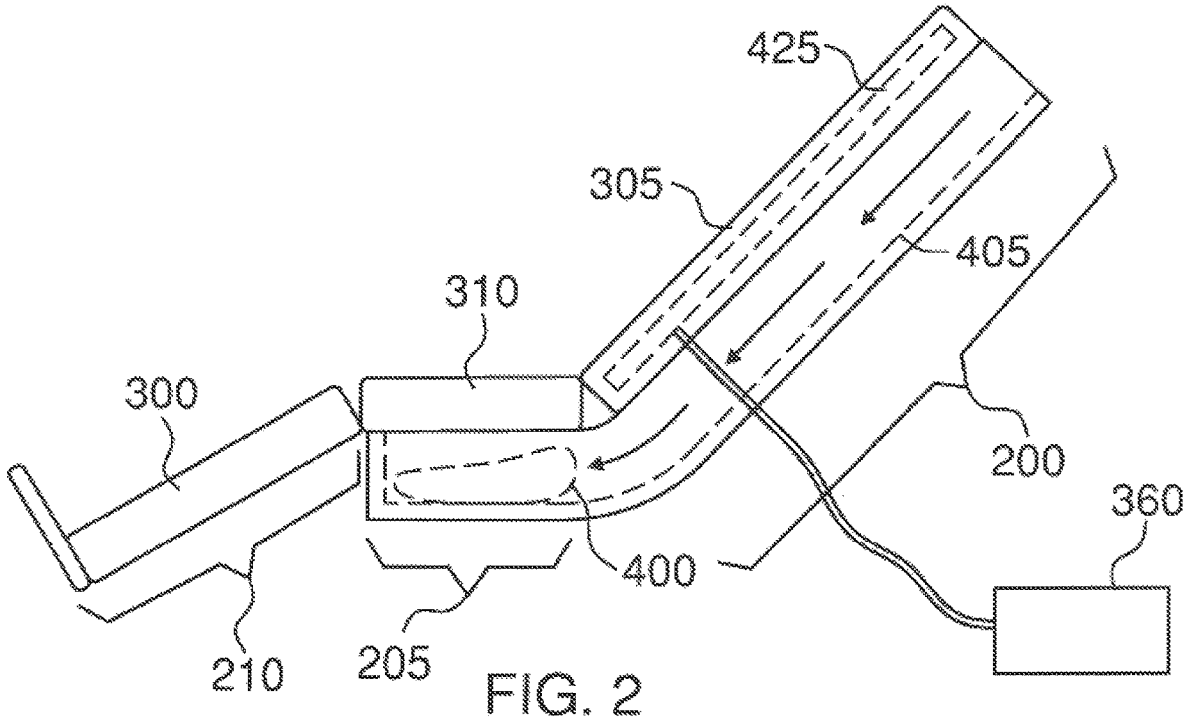
FIG. 2 is a side view of an embodiment of the disclosure.
Figure 3:
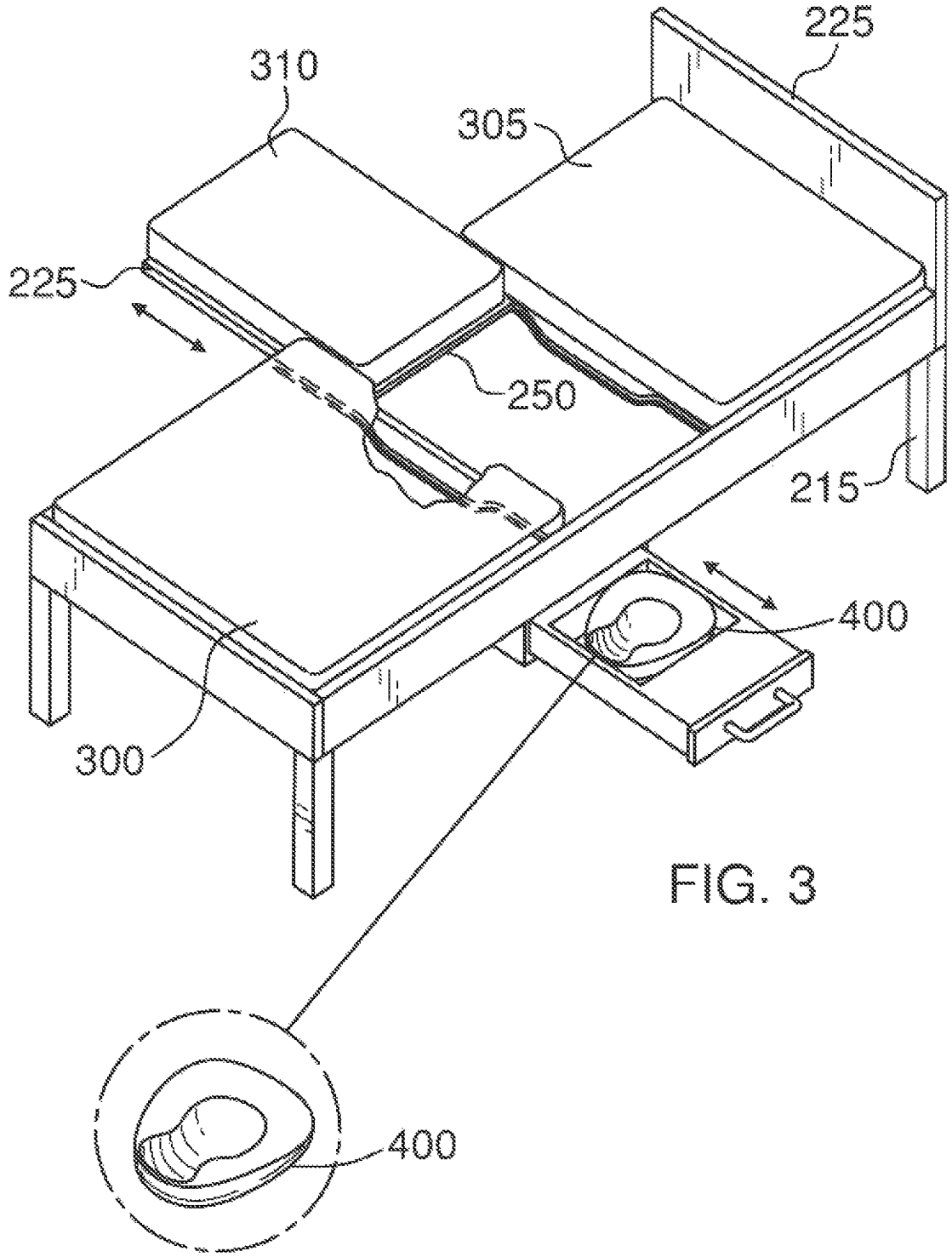
FIG. 3 is a perspective view of an embodiment of the disclosure illustrating movement of the mid mattress on the sliding tray.
Figure 4:
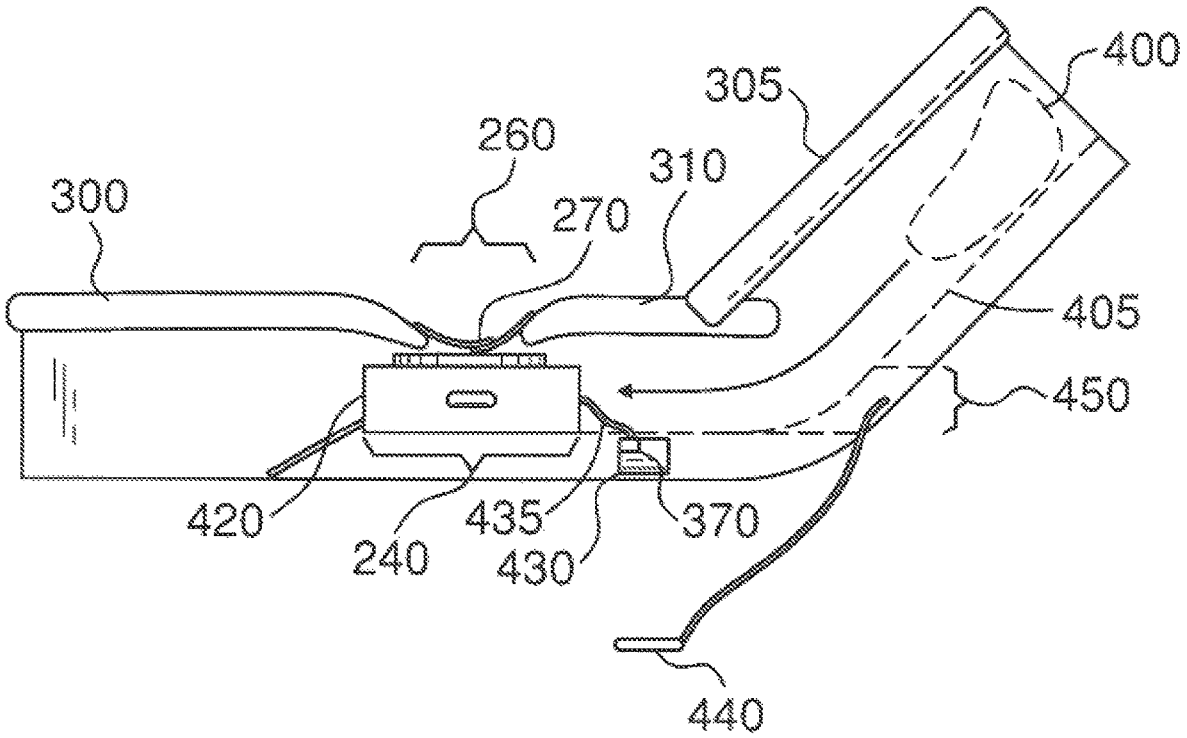
FIG. 4 is a side view of an embodiment of the disclosure illustrating the ergonomic region of the mattress and the pump for sanitizing fluid.
Figure 5:
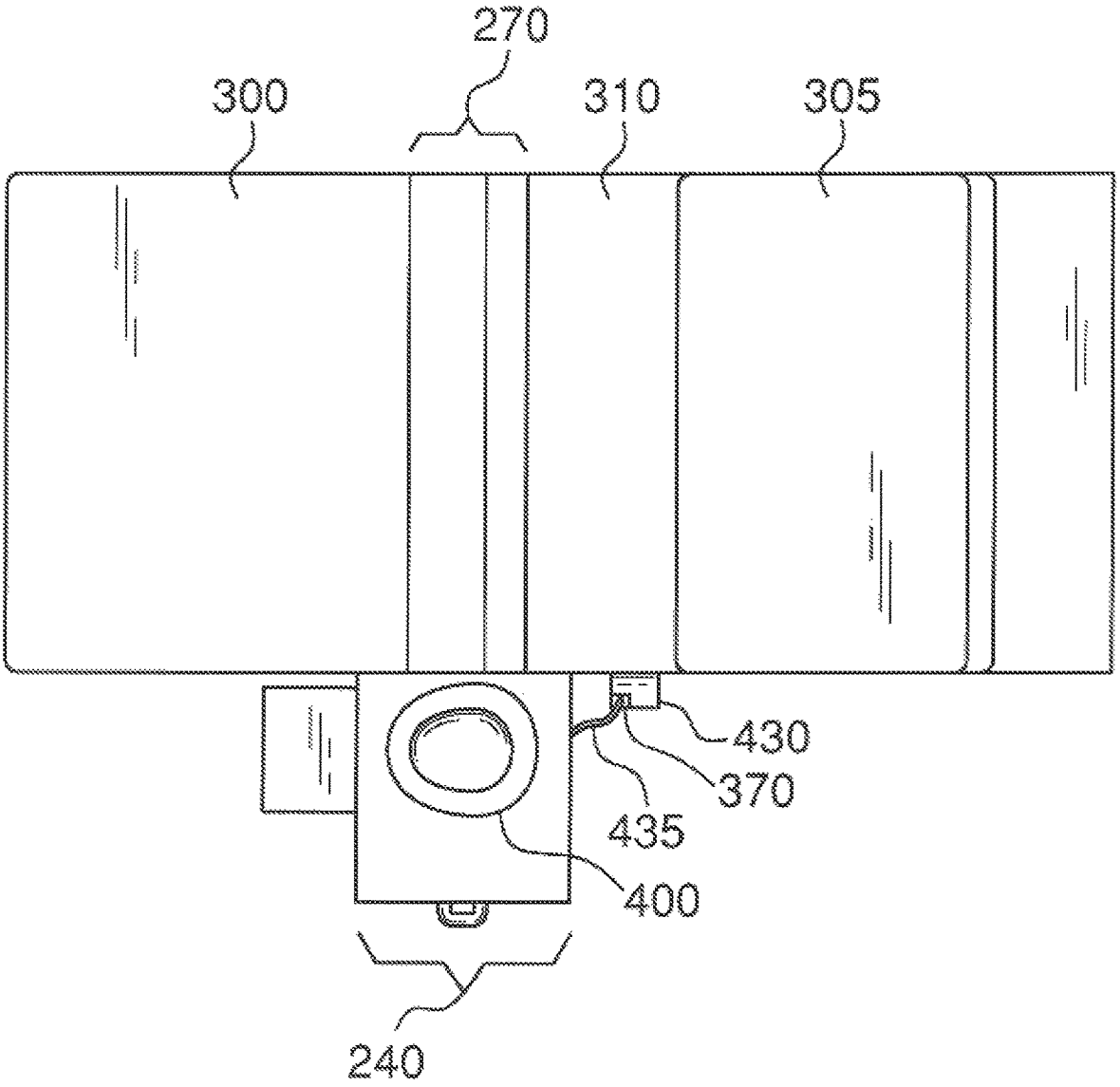
FIG. 5 is a top view of an embodiment of the disclosure illustrating the ergonomic region of the mattress and the pump for sanitizing fluid.

Detailed reference will now be made to a first potential embodiment of the disclosure, which is illustrated in FIGS. 1 through 5.

The patient bed with mattress and integrated bed pan 100 (hereinafter invention) comprises a head frame 200, a midframe 205, a foot frame 210, an underframe 215, a leg mattress 300, a torso mattress 305, a mid mattress 310, a receiving compartment 235, and a bed pan 400. The invention 100 is a bed wherein the bed pan 400 is integral to the midframe 205. The invention 100 is adapted to allow a patient (not illustrated in the figures) to urinate and have bowel movements without leaving the bed. The invention 100 is adapted to permit the patient to stay in the bed while the bed pan 400 is retrieved.

Throughout this disclosure, directional references are given with respect to a patient lying in the bed on their back. Head refers to the end of the bed where the patient's head is located and foot is the opposite end of the bed from head. Left refers to the side of the bed on the patient's left and right is the side of the bed that is opposite the left side. "Up" and "down" are defined with respect to gravity.

The head frame 200, the midframe 205, the foot frame 210, and the underframe 215 comprise a bed frame. The head frame 200 supports the torso mattress 305. The foot frame 210 supports the leg mattress 300. The midframe 205 supports the mid mattress 310.

The head frame 200, the midframe 205, and the foot frame are linearly aligned with each other. Specifically, one end of the midframe 205 is pivotally coupled to the foot frame 210 and the opposite end of the midframe 205 is pivotally coupled to the head frame 200.

When in a non-inclined state, the head frame 200, the midframe 205, and the foot frame 210 may form a horizontal plane and may be adapted for the patient, resting on the torso mattress 305, the mid mattress 310, and the leg mattress 300 above the bed frame, to lie in a supine position or a prone position.

The head end of the head frame 200 may be elevated and the foot end of the foot frame 210 may be lowered to place the bed frame in an inclined state. When in the inclined state, the head frame 200, the midframe 205, and the foot frame 210 may be adapted to place the patient into a seated posture.

The underframe 215 may comprise support armatures beneath the frame, legs, castors, brakes, or combinations thereof. The underframe 215 may hold the head frame 200, the foot frame 210, and the midframe 205 above a floor (not illustrated in the figures) and may provide mobility for moving the bed within a building.

The invention 100 may comprise a head rest 225, a foot rest 220, and two or more side rails 230 that are adapted to prevent the patient from falling out of the bed. The head rest 225 may be coupled to the head end of the head frame 200. The foot rest 220 may be coupled to the foot end of the foot frame 210. The two or more side rails 230 may be coupled to opposing lateral sides of the head frame 200, the foot frame 210, the midframe 205, or combinations thereof. The two or more side rails 230 may be hinged such that an individual side-rail selected from the two or more side rails 230 may be dropped below the level of the mattresses.

The torso mattress 305, the mid mattress 310, and the leg mattress 300 may each be a rectangular pad covered with cloth and containing a resilient material or framework of springs. The torso mattress 305 may be sized to fit the head frame 200. The mid mattress 310 may be sized to fit the midframe 205. The leg mattress 300 may be sized to fit the foot frame 210. The torso mattress 305, the mid mattress 310, and the leg mattress 300 may be substantially the same thickness, as measured from the frame side of an individual mattress to the opposing side of the same mattress, so as to form a planar upper surface when the bed is in the non-inclined state.

The midframe 205 may comprise the receiving compartment 235 for holding the bed pan 400. The receiving compartment 235 may be adapted to position the bed pan 400 beneath the genitals and rectum of the patient while the patient is occupying the bed.

In some embodiments, the receiving compartment 235 may comprise a drawer 240 coupled to a pair of drawer rails 245 that are in turn coupled to the midframe 205 such that the bed pan 400 may be retrieved from the bed by pulling the drawer 240 out and lifting the bed pan 400 out of the drawer 240.

In some embodiments, the bed pan 400 may be made accessible by removing the mid mattress 310 from the bed. As a non-limiting example, the midsection of the patient may be lifted to slide the mid mattress 310 off the bed, thus exposing the bed pan 400 for use.

In some embodiments, the midframe 205 may comprise a sliding tray 250 that supports the mid mattress 310 on top of the midframe 205. The sliding tray 250 may be coupled to a pair of tray rails 255 that are in turn coupled to the midframe 205 such that the mid mattress 310 may be pulled laterally to a side of the bed without having to remove the mid mattress 310 from the bed.

In some embodiments, the leg mattress 300, the mid mattress 310, or a combination thereof may comprise an ergonomic region 260 adapted to match the contour of the midsection of the patient. The ergonomic region 260 may provide one or more access flaps 270 that may be opened to provide access to the bed pan 400.

The bed pan 400 may be an open-topped, impervious container for catching and holding urine and bowel movements.

In some embodiments, the head frame 200 may comprise a guide track 405 running below the torso mattress 305 from the head rest 225 longitudinally through the head frame 200 to the midframe 205. The drawer 240 may comprise a drawer rear aperture which is located on the head frame 200 side of the drawer 240 and which is aligned with the midframe 205 end of the guide track 405. The bed pan 400 which is empty may be released into a bed pan aperture 415 located at the head end of the bed when the head frame 200 is inclined and the guide track 405 will guide the bed pan 400 as it slides down through the head frame 200, arriving at the drawer rear aperture 410 and entering the drawer 240 through the drawer rear aperture 410.

The invention 100 may comprise a plurality of restraint straps 350 adapted to hold the patient to the bed while the bed is in the inclined state. The plurality of restraint straps 350 may attached to opposing lateral sides of the bed and may decouple using buckles, snaps, hook and loop fasteners, or a combination thereof.

The invention 100 may comprise an inflatable bladder 425 within the torso mattress 305 and an air pump 360. The air pump 360 may force air into the inflatable bladder 425 to increase firmness of the torso mattress 305 during use of the bed pan 400.

The invention 100 may comprise a fluid pump 370 which may pump sanitizing fluid (not illustrated in the figures) into the bed pan 400 from a fluid reservoir 430 via tubing 435. The fluid pump 370 may be operated using a foot pedal 440.

In some embodiments, the drawer 240 may comprise a drawer front aperture 420. The bed pan 400 may be inserted into the receiving compartment 235 or retrieved from the receiving compartment 235 via the drawer front aperture 420.

In some embodiments, the head frame 200 may comprise a rear bed pan passage 450. The bed pan 400 may be inserted into the receiving compartment 235 or retrieved from the receiving compartment 235 via the rear bed pan passage 450.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

As used herein, the words "couple", "couples", "coupled" or "coupling", refer to connecting, either directly or indirectly, and does not necessarily imply a mechanical connection.

As used in this disclosure, a "drawer" is a storage compartment that is designed to slide into and out of a larger object.

As used in this disclosure, a "flap" is a piece of material that is hinged or otherwise attached to a surface using one side such that the piece of material hangs in such a way as to cover a hole in a surface or to provide a barrier between objects.

As used in this disclosure, a "floor" refers to the inferior horizontal surface of a room or structure.

As used herein, "front" indicates the side of an object that is closest to a forward direction of travel under normal use of the object or the side or part of an object that normally presents itself to view or that is normally used first. "Rear" or "back' refers to the side that is opposite the front.

As used in this disclosure, a "headrest" is a pad that attaches to or extends from the back of a seat.

As used in this disclosure, a "hook and loop fastener" is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface.

As used in this disclosure, "horizontal" is a directional term that refers to a direction that is perpendicular to the local force of gravity. Unless specifically noted in this disclosure, the horizontal direction is always perpendicular to the vertical direction.

As used herein, "impervious" refers to the characteristic of an object that prevents fluids from passing through the object.

As used in this disclosure, the word "lateral" refers to the sides of an object or movement towards a side. Lateral directions are generally perpendicular to longitudinal directions. "Laterally" refers to movement in a lateral direction.

As used herein, the word "longitudinal" or "longitudinally" refers to a lengthwise or longest direction.

As used herein, "mattress" refers to a pad for supporting a reclining body. Mattresses are frequently used on beds. The mattress may be a fabric casing, sometimes quilted, and filled with hair, straw, cotton, foam rubber, a framework or metal springs, or other padding or suspension.

As used herein, "opposing lateral sides" refers to two locations that are on opposite sides of a longitudinal center line that divides an object.

As used in this disclosure, a "patient" is a person who is designated to receive a medical treatment, therapy or service. The term patient may be extended to an animal when used within the context of the animal receiving veterinary treatment or services As used in this disclosure, a "pump" is a mechanical device that uses suction or pressure to raise or move fluids, compress fluids, or force a fluid into an inflatable object.

As used in this disclosure, a "reservoir" refers to a container or containment system that is configured to store a liquid.

As used in this disclosure, "resilient" or "semirigid" refer to an object or material which will deform when a force is applied to it and which will return to its original shape when the deforming force is removed.

As used in this disclosure, a "spring" is a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used herein, the word "substantially" indicates that two or more attributes are the same except for a margin of error related to variances in materials, manufacturing processes, craftsmanship, installation, environmental conditions, or other factors that may influence the attributes and that the differences introduced by these factors are tolerable.

As used in this disclosure, a "track" is a device that is used to control the path of motion of an object in at least one dimension.

As used in this disclosure, a "tube" is a hollow cylindrical device that is used for transporting liquids and gases. In this disclosure, the terms inner diameter and outer diameter are used as they would be used by those skilled in the plumbing arts. The line that connects the center of the first base of the cylinder to the center of the second base of the cylinder and is equidistant from the outer surface of the tube for its entire length is referred to as the centerline of the tube. When two tubes share the same centerline they are said to be aligned. When the centerlines of two tubes are perpendicular to each other, the tubes are said to be perpendicular to each other. As used here, "tubing" refers to a tube that is flexible or resilient.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A patient bed with mattress and integrated bed pan comprising:

a head frame, a midframe, a foot frame, an underframe, a leg mattress, a torso mattress, a mid mattress, a receiving compartment, and a bed pan;

wherein the patient bed with mattress and integrated bed pan is a bed wherein the bed pan is integral to the midframe;

wherein the patient bed with mattress and integrated bed pan is adapted to allow a patient to urinate and have bowel movements without leaving the bed;

wherein the patient bed with mattress and integrated bed pan is adapted to permit the patient to stay in the bed while the bed pan is retrieved;

wherein the receiving compartment comprises a drawer coupled to a pair of drawer rails that are in turn coupled to the midframe;

wherein the head frame comprises a guide track running below the torso mattress from a head rest longitudinally through the head frame to the midframe;

wherein the drawer comprises a drawer rear aperture which is located on a head frame side of the drawer and which is aligned with a midframe end of the guide track.

2. The patient bed with mattress and integrated bed pan according to claim 1 wherein the head frame, the midframe, the foot frame, and the underframe comprise a bed frame;

wherein the head frame supports the torso mattress;

wherein the foot frame supports the leg mattress;

wherein the midframe supports the mid mattress.

3. The patient bed with mattress and integrated bed pan according to claim 2 wherein the head frame, the midframe, and the foot frame are linearly aligned with each other;

wherein one end of the midframe is pivotally coupled to the foot frame and an opposite end of the midframe is pivotally coupled to the head frame.

4. The patient bed with mattress and integrated bed pan according to claim 3 wherein when in a non-inclined state, the head frame, the midframe, and the foot frame form a horizontal plane;

wherein when in a non-inclined state, the head frame, the midframe, and the foot frame are adapted for the patient, resting on the torso mattress, the mid mattress, and the leg mattress above the bed frame, to lie in a supine position or a prone position.

5. The patient bed with mattress and integrated bed pan according to claim 4 wherein the head end of the head frame is elevated and the foot end of the foot frame is lowered to place the bed frame in an inclined state;

wherein when in the inclined state, the head frame, the midframe, and the foot frame are adapted to place the patient into a seated posture.

6. The patient bed with mattress and integrated bed pan according to claim 5 wherein the underframe comprises legs, castors, or combinations thereof;

wherein the underframe holds the head frame, the foot frame, and the midframe above a floor and provides mobility for moving the bed within a building.

7. The patient bed with mattress and integrated bed pan according to claim 6 wherein the patient bed with mattress and integrated bed pan comprises the head rest, a foot rest, and two or more side rails that are adapted to prevent the patient from falling out of the bed;

wherein the head rest is coupled to a head end of the head frame;

wherein the foot rest is coupled to a foot end of the foot frame;

wherein the two or more side rails are coupled to opposing lateral sides of the head frame, the foot frame, the midframe, or combinations thereof.

8. The patient bed with mattress and integrated bed pan according to claim 6 wherein the torso mattress, the mid mattress, and the leg mattress are each rectangular pads covered with cloth and containing a resilient material or framework of springs;

wherein the torso mattress is sized to fit atop the head frame;

wherein the mid mattress is sized to fit atop the midframe;

wherein the leg mattress is sized to fit atop the foot frame;

wherein the torso mattress, the mid mattress, and the leg mattress are substantially the same thickness, as measured from the frame side of an individual mattress to the opposing side of the same mattress, so as to form a planar upper surface when the bed is in the non-inclined state.

9. The patient bed with mattress and integrated bed pan according to claim 8 wherein the midframe comprises the receiving compartment for holding the bed pan;

wherein the receiving compartment is adapted to position the bed pan beneath the genitals and rectum of the patient while the patient is occupying the bed.

10. The patient bed with mattress and integrated bed pan according to claim 9 wherein the midframe comprises a sliding tray that supports the mid mattress on top of the midframe;

wherein the sliding tray is coupled to a pair of tray rails that are in turn coupled to the midframe such that the mid mattress is pulled laterally to a side of the bed without having to remove the mid mattress from the bed.

11. The patient bed with mattress and integrated bed pan according to claim 9 wherein the bed pan is configured to be accessible, and the mid mattress is removable from the bed.

12. The patient bed with mattress and integrated bed pan according to claim 11 wherein the leg mattress, the mid mattress, or a combination thereof comprises an ergonomic region adapted to match the contour of the midsection of the patient;

wherein the ergonomic region provides one or more access flaps that open to provide access to the bed pan.

13. The patient bed with mattress and integrated bed pan according to claim 11 wherein the bed pan is an open-topped, impervious container for catching and holding urine and bowel movements.

14. The patient bed with mattress and integrated bed pan according to claim 11 wherein the patient bed with mattress and integrated bed pan comprises a plurality of restraint straps adapted to hold the patient to the bed while the bed is in the inclined state;

wherein the plurality of restraint straps attach to opposing lateral sides of the bed and decouple using buckles, snaps, hook and loop fasteners, or a combination thereof.

15. The patient bed with mattress and integrated bed pan according to claim 11 wherein the patient bed with mattress and integrated bed pan comprises an inflatable bladder within the torso mattress and an air pump;

wherein the air pump forces air into the inflatable bladder to increase firmness of the torso mattress during use of the bed pan.

16. The patient bed with mattress and integrated bed pan according to claim 11 wherein the patient bed with mattress and integrated bed pan comprises a fluid pump which pumps sanitizing fluid into the bed pan from a fluid reservoir via tubing;

wherein the fluid pump is operated using a foot pedal.

17. The patient bed with mattress and integrated bed pan according to claim 11 wherein the drawer comprises a drawer front aperture.

18. The patient bed with mattress and integrated bed pan according to claim 11 wherein the head frame comprises a rear bed pan passage.

* * * * *